US010709271B2

(12) United States Patent
Northrop

(10) Patent No.: US 10,709,271 B2
(45) Date of Patent: Jul. 14, 2020

(54) CHILD SNACKING DEVICE

(71) Applicant: Lynn B. Northrop, Amherst, NY (US)

(72) Inventor: Lynn B. Northrop, Amherst, NY (US)

( * ) Notice: Subject to any disclaimer, the term of this patent is extended or adjusted under 35 U.S.C. 154(b) by 0 days.

(21) Appl. No.: 15/439,136

(22) Filed: Feb. 22, 2017

(65) Prior Publication Data

US 2018/0235388 A1 Aug. 23, 2018

(51) Int. Cl.
*A47G 19/30* (2006.01)

(52) U.S. Cl.
CPC ..... *A47G 19/30* (2013.01)

(58) Field of Classification Search
CPC ..... A47G 19/30; A47G 29/30; A47G 29/093; B65D 25/24; B65D 51/245; B65D 85/70
USPC ..... 206/457; 15/118, 106, 211
See application file for complete search history.

(56) References Cited

U.S. PATENT DOCUMENTS 2,893,029 A * 7/1959 Vosbikian ..... A47L 17/00 15/118
8,083,860 B2 * 12/2011 Loftis ..... A46B 13/005 134/21
8,336,156 B1 * 12/2012 Shimazu ..... A47L 19/00 15/164
2004/0060577 A1 * 4/2004 Dunn ..... A46B 5/0095 134/8
2005/0184099 A1 * 8/2005 McKay ..... A01K 13/002 222/192
2009/0209181 A1 * 8/2009 Burnett ..... B24B 23/02 451/344
2014/0013610 A1 * 1/2014 Kilgore ..... A47L 19/00 34/95.1
2015/0335222 A1 * 11/2015 Jones ..... A47L 13/16 15/209.1

* cited by examiner

*Primary Examiner* — Chun Hoi Cheung
(74) *Attorney, Agent, or Firm* — The Webb Law Firm

(57) ABSTRACT

A child snacking device is disclosed. The child snacking device may include a handle, having a first end and a second end with an elongated region extending therebetween, and a plurality of food restraining surfaces comprising polymeric microfiber fabric, with the plurality of food restraining surfaces extending from a portion of the handle. The child snacking device may include a core region with a plurality of food restraining surfaces comprising polymeric microfiber fabric extending from the core region. The food restraining surfaces may removably adhere a cereal-based food product thereto.

22 Claims, 16 Drawing Sheets

CHILD SNACKING DEVICE

BACKGROUND OF THE INVENTION

Field of the Disclosure

The present application relates to a snacking or feeding device for children and/or toddlers.

Description of the Related Art

One of the most critical transitions in the developing child is the ability of a child to eat solid food and to feed themselves. Snacking and feeding devices are used to encourage young children and toddlers to feed themselves, and particularly to develop the fine motor skills required to manipulate solid or semi-solid foods. Proper feeding devices can be useful in establishing successful eating patterns, and snacking or feeding devices having sufficient play-pattern interest can help maintain a child's interest in the feeding process for an increased duration. Snacking and feeding devices must be constructed of nontoxic materials, and must not contain small parts that can break or dissociate in a child's mouth.

Snacking and feeding devices for small children and toddlers should be useable by a child without direct adult supervision and must be have a construction that will not injure the mouth or eyes of the child user. It is desirable that a snacking device promote proper oral skill development and motor skill manipulation by the child user. As children often tire quickly of the feeding process, there exists a need for an improved snacking or feeding device that will increase a child's attention span for feeding by combining attractive food presentation with motor skill development requirements.

As the development of early feeding often coincides with early walking and crawling, care must be exercised to limit accidental spills of food products, resulting in potential food contamination.

SUMMARY OF THE INVENTION

In accordance with an embodiment of the present invention, a child snacking device includes a handle, having a first end and a second end with an elongated region extending therebetween. The snacking device also includes a plurality of food restraining surfaces including polymeric microfiber fabric, with the plurality of food restraining surfaces extending from a portion of the handle.

In some configurations, the polymeric microfiber fabric is made of polyester, polyamide, polypropylene, or combinations thereof. The polymeric microfiber fabric may optionally include towel terry, French terry, and/or looped regions.

The first end of the handle may include an attachment foot, such as a suction cup, for securing the handle to a solid surface. Optionally, the elongated region of the handle may include at least one ergonomical gripping rib. In certain configurations, the plurality of food restraining surfaces are disposed about a portion of the handle and secured thereto by a retaining cap. In other configurations, the plurality of food restraining surfaces are disposed adjacent the second end of the handle and the retaining cap is permanently affixed to the second end of the handle, with at least a portion of the food restraining surfaces captured by the retaining cap.

The plurality of food restraining surfaces may include a first layer of food restraining surfaces and a second layer of food restraining surfaces, wherein at least a portion of the second layer of food restraining surfaces overlaps at least a portion of the first layer of food restraining surfaces. Optionally, the plurality of food restraining surfaces may include a third layer of food restraining surfaces, wherein at least a portion of the third layer of food restraining surfaces overlaps at least a portion of at least one of the first layer of food restraining surfaces and the second layer of food restraining surfaces.

In certain configurations, the food restraining surfaces comprise at least one concave region. The concave region may include at least one of a pocket, depression, or folded region for restraining a food product therein. The food restraining surfaces removably adhere a cereal-based food product thereto. The food restraining surfaces may removably adhere the cereal-based food product thereto such that a child may remove the food product from the food restraining surfaces with their fingers or mouth. In certain configurations, the food restraining surfaces are petal-shaped and the elongated handle is stem-shaped, providing the child snacking device with the overall appearance of a flower.

In yet other configurations, the retaining cap includes at least one of indicia or a figural addition thereon. The figural addition may have an animal, sports logo, or other iconic shape.

In accordance with another embodiment of the invention, a child snacking device includes a core region and a plurality of food restraining surfaces including polymeric microfiber fabric extending from the core region, with the food restraining surfaces removably adhering a cereal-based food product thereto.

In one configuration, the polymeric microfiber fabric is made of polyester, polyamide, polypropylene, or combinations thereof. Optionally, the polymeric microfiber fabric may include towel terry, French terry, and/or looped regions.

In one configuration, the plurality of food restraining surfaces includes a first layer of food restraining surfaces and a second layer of food restraining surfaces, wherein at least a portion of the second layer of food restraining surfaces overlaps at least a portion of the first layer of food restraining surfaces. Optionally, the plurality of food restraining surfaces includes a third layer of food restraining surfaces, with at least a portion of the third layer of food restraining surfaces overlapping at least a portion of at least one of the first layer of food restraining surfaces and the second layer of food restraining surfaces.

In certain configurations, the food restraining surfaces include at least one concave region. Optionally, the concave region includes at least one of a pocket, depression, or folded region for restraining a food product therein. The food restraining surfaces removably adhere a cereal-based food product thereto. The food restraining surfaces may removably adhere the cereal-based food product thereto such that a child may remove the food product from the food restraining surfaces with their fingers or mouth. In certain configurations, the food restraining surfaces are petal-shaped and the elongated handle is stem-shaped, providing the child snacking device with the overall appearance of a flower.

In accordance with yet another embodiment, a child snacking device includes a plurality of food restraining surfaces comprising polymeric microfiber fabric, wherein the food restraining surfaces removably adhere a cereal-based food product thereto. The food restraining surfaces may removably adhere the cereal-based food product thereto such that a child may remove the food product from the food restraining surfaces with their fingers or mouth.

In certain configurations, the polymeric microfiber fabric is made of polyester, polyamide, polypropylene, or combinations thereof. Optionally, the polymeric microfiber fabric comprises towel terry, French terry, and/or looped regions.

DETAILED DESCRIPTION OF THE EMBODIMENTS

Figure 1:
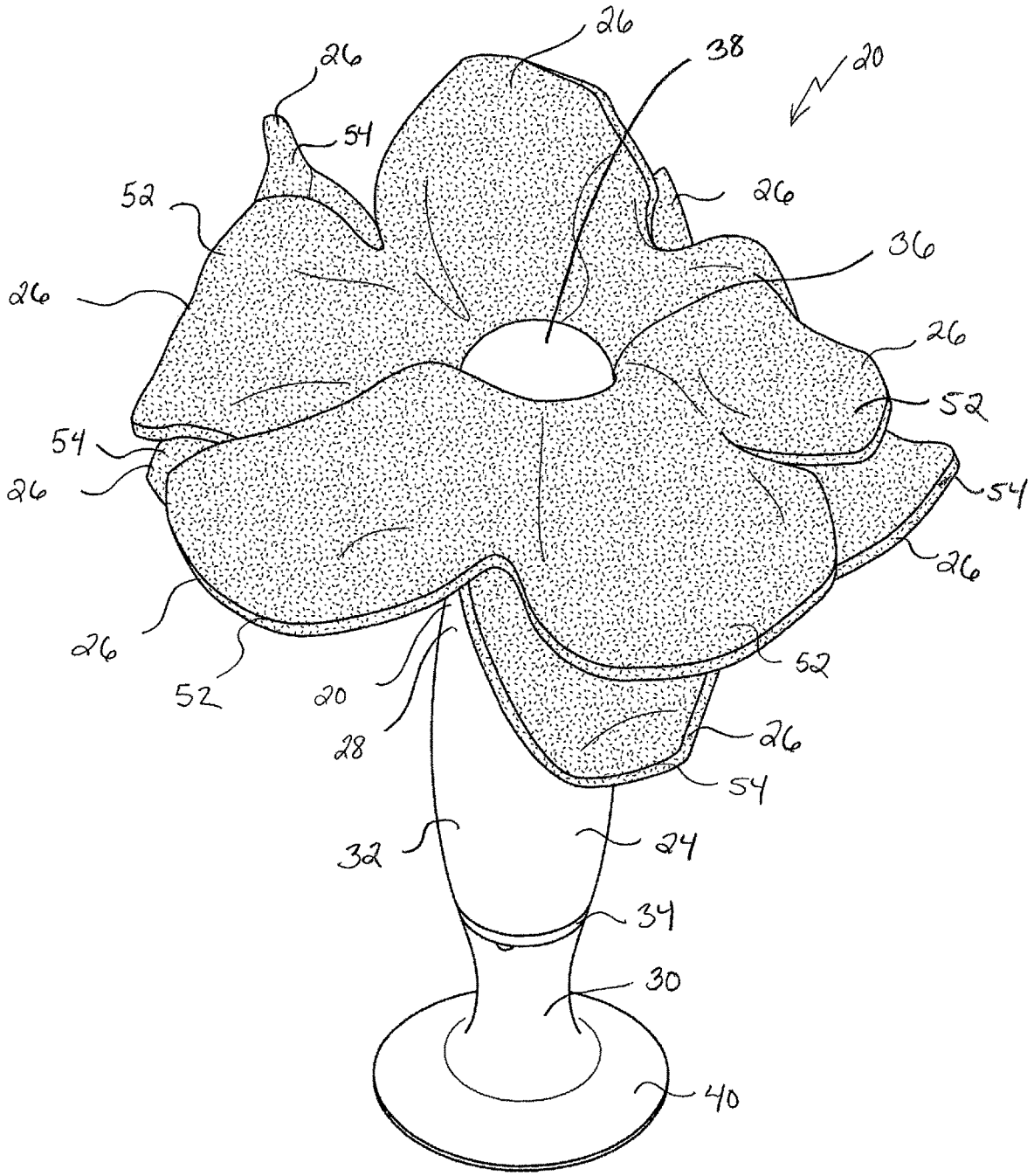
FIG. 1 is a perspective side view of a child snacking device in accordance with an embodiment of the present invention

The present invention is directed to an apparatus, such as a snacking or feeding device, that presents food product, such as dry cereal, to a toddler or young child in a manner that encourages the toddler or child to feed itself. The apparatus of the present invention allows for food product, such as individual pieces of dry cereal, to be removably held on the apparatus until a child picks off the individual pieces for consumption. The apparatus is intended to present the food product in an interactive and visually pleasing format to child for the purpose of promoting good food patterns, and improving manual dexterity.

Referring to FIGS. 1-5, the child snacking apparatus 20 includes a core region 22, such as a handle 24 and a plurality of food restraining surfaces 26 extending therefrom. In one embodiment, the handle 24 includes a first end 30 and a second end 28 with an elongated region 32 extending therebetween. The handle 24 may be formed of suitable wood or food-safe polymeric material(s) such as polyethylene terephthalate (PET), polypropylene (PP), high-density polyethylene (HDPE), low-density polyethylene (LDPE) and/or polycarbonate (PC). Optionally, the handle may include an ergonomical curvature allowing for easy grasping by a child user. In a further embodiment, the handle 24 may include at least one ergonomical gripping rib 34 allowing for enhanced grasping. In certain configurations, the handle may include a textural or soft food-safe elastomer covering for providing a pliant grasping portion.

Optionally, the first end 30 may be provided with an attachment foot 40 for securing the handle 24 to a solid surface. In one configuration, the attachment foot 40 may include a suction cup to allow for releasably securing the child snacking apparatus 20 to a table, tray, or other solid surface. In another configuration, the attachment foot 40 may include a weighted base element to minimize tipping or accidental knocking over of the child snacking apparatus 20. The attachment foot 40 may be co-formed with a portion of the handle 24, or may be separately formed and subsequently joined with a portion of the handle 24 for use. The attachment foot 40 allows for the child snacking apparatus 20 to be held in an upright orientation without requiring that the child user grasp the snacking apparatus 20 at all times.

It is contemplated herein that the attachment foot 40 of the snacking apparatus 20 of the present invention may also include an attachment hook or other binding, such as a hinged clip, for securing at least a portion of the device to another structure, such as a portion of a stroller, the clothing of child, a backpack, or the like. It is further contemplated herein that the attachment foot 40 of the child snacking apparatus 20 may include a peg or clamp couplable with other traditional toddler or small child furniture items, such as seats, highchairs, feeding trays and tables, play yards, and other restraining devices.

In one embodiment, a plurality of food restraining surfaces 26 may be provided extending from the core region 22. The core region 22 may be any capture element for permanently securing the plurality of food restraining surfaces 26 thereto. In one embodiment, the core region 22 is contiguously formed with the handle 24. In another embodiment, the core region 22 restrains the plurality of food restraining surfaces 26, such as at a center region 36 of the plurality of food restraining surfaces 26, such that the plurality of food restraining surfaces 26 extend from the core region 22. In yet another embodiment, the plurality of food restraining surfaces extend from a portion of the handle 24, such as adjacent the second end 28.

In one embodiment, the plurality of food restraining surfaces 26 comprise a non-toxic food safe polymeric microfiber fabric, or regions of polymeric microfiber fabric at least partially bounded by another fabric or polymeric material.

The polymeric microfiber fabric may be made of polyester, polyamide, polypropylene, and/or combinations thereof. In certain configurations, the polymeric microfiber fabric may comprise towel terry, French terry, and/or looped regions. In other configurations, the polymeric microfiber fabric may include regions of towel terry or French terry at least partially bounded by looped regions, and vice versa. The plurality of food restraining surfaces 26 may be single faced, such as provided on a single surface of a fabric element, or may be double faced, such as provided on opposing sides of a fabric element, i.e. front and back of a fabric element. In yet another alternative, the plurality of food restraining surfaces 26 may be provided on a plurality of fabric surfaces, i.e. pyramid shaped, or other 3-dimensionally shaped fabric elements.

The plurality of food restraining surfaces 26 may be disposed about a portion of the handle 24 and secured thereto by a retaining cap 38. The handle 24 and the retaining cap 38 may be provided with any suitable attachment elements, such that the plurality of food restraining surfaces 26 is permanently captured therebetween. In one embodiment, the second end 28 of the handle 24 includes a one-way fastener which passes through a portion of the plurality of food restraining surfaces 26 and the retaining cap 38 includes a one-way lock for engaging the one-way fastener to be permanently affixed to the retaining cap 38 and to the handle 24. Optionally, an exterior surface of the retaining cap 38 may have indicia and/or a figural element disposed thereon, as will be discussed herein.

Figure 2:
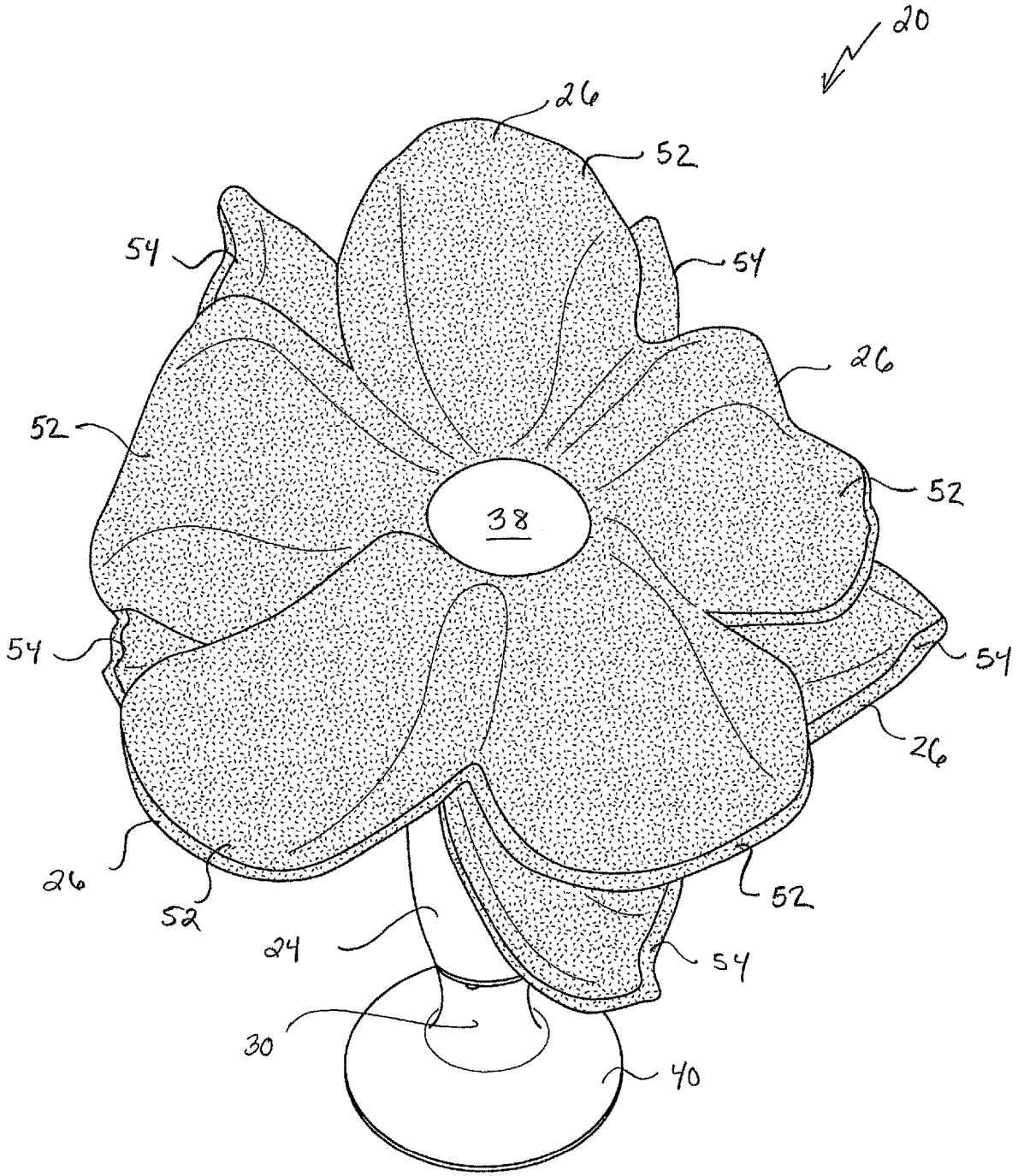
FIG. 2 is a topwardly-directed perspective view of the child snacking device of FIG. 1 in accordance with an embodiment of the present invention.

As shown with specific reference to FIGS. 1-2, the child snacking apparatus 20 may have a visually pleasing overall appearance resembling a commonly identifiable object, such as a flower. With specific reference to FIGS. 1-2, the handle 24 may be stem-shaped and the plurality of food restraining surfaces 26 may be petal-shaped. It is contemplated herein that child snacking apparatus 20 can have the overall appearance resembling other commonly identifiable objects, such as trees, nests, cups, balls, animals, or other shapes, without departing from the spirit of the present invention. In one embodiment, portions of the device or the entirety of the child snacking apparatus 20 may have bright colors and/or patterns included thereon. In one embodiment, the child snacking apparatus 20 may have indicia provided thereon, such as sports logos, or other source identifier indicia. The overall appearance of the child snacking apparatus 20 can be similar to that of a toy or play object so as to retain the attention and enhance the experience of the child user.

Figure 3:
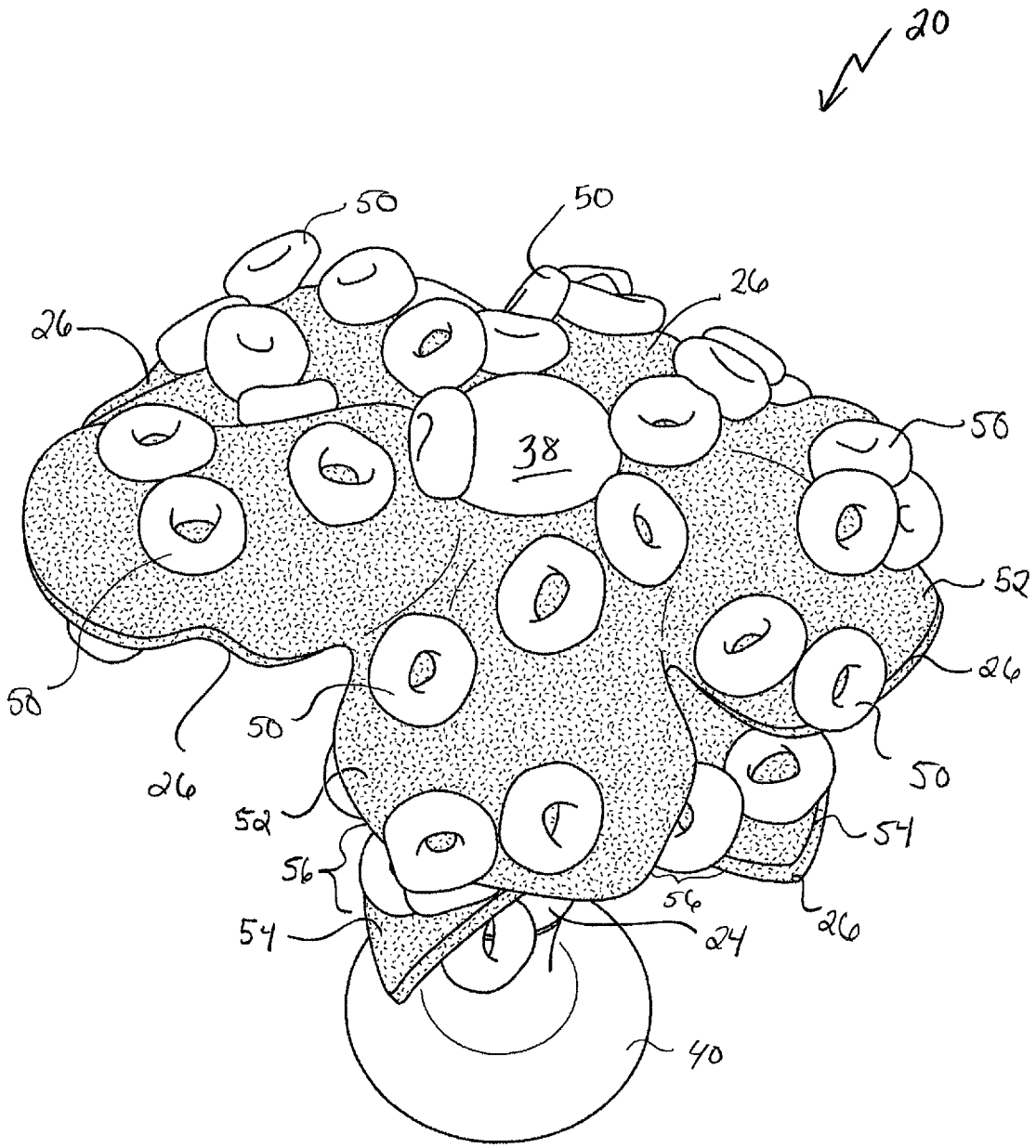
FIG. 3 is a topwardly-directed perspective view of the child snacking device of FIG. 1 having a ring-shaped food product removably adhered to the food restraining surfaces in accordance with an embodiment of the present invention.
Figure 4:
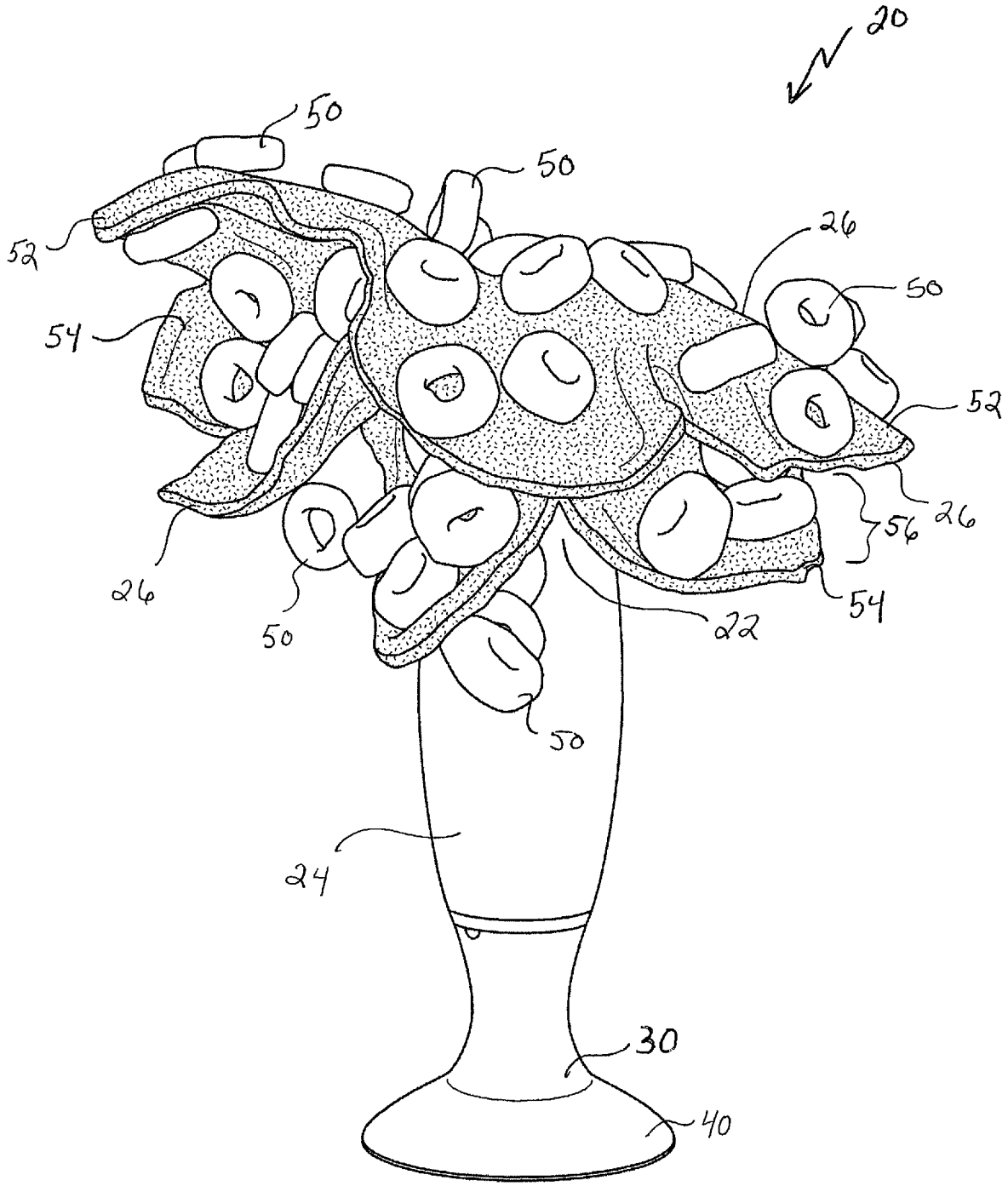
FIG. 4 is a side view of the child snacking device of FIG. 3 having the ring-shaped food product removably adhered to the food restraining surfaces in accordance with an embodiment of the present invention.
Figure 5:
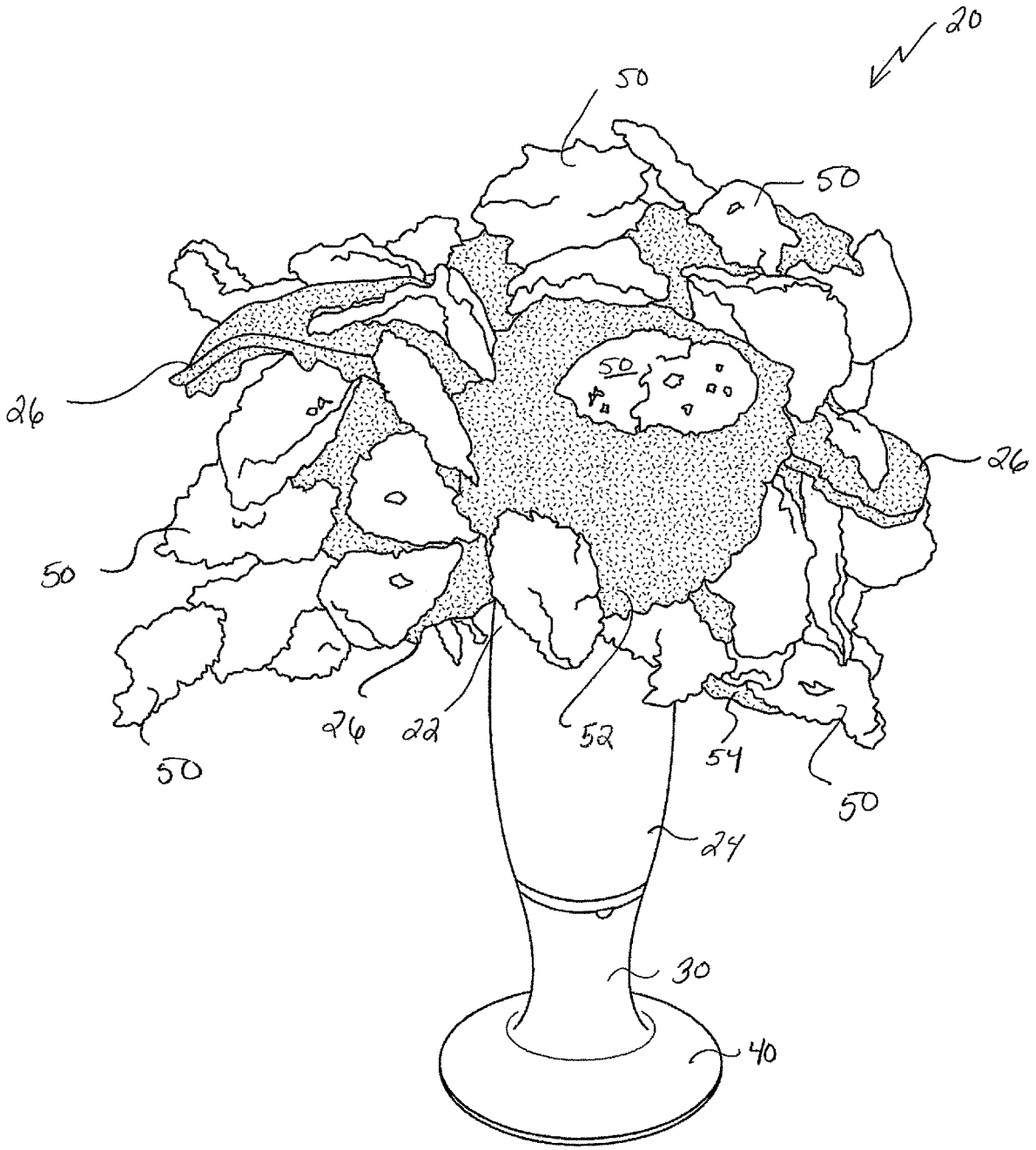
FIG. 5 is a perspective side view of the child snacking device of FIG. 1 having a flake-shaped food product removably adhered to the food restraining surfaces in accordance with an embodiment of the present invention.
Figure 6:
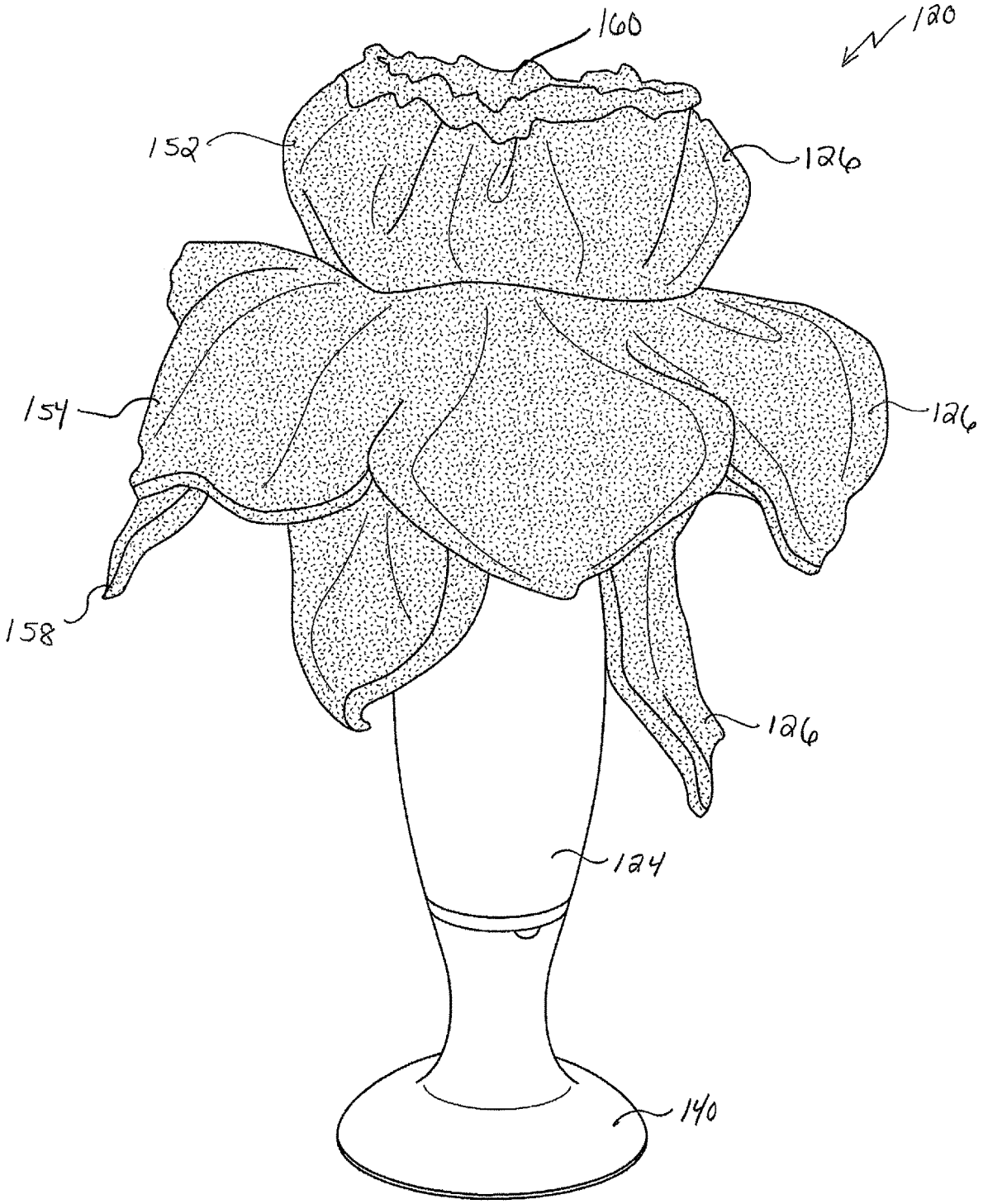
FIG. 6 is a side view of a child snacking device having a first, second, and third plurality of food restraining surfaces in accordance with an embodiment of the present invention.
Figure 7:
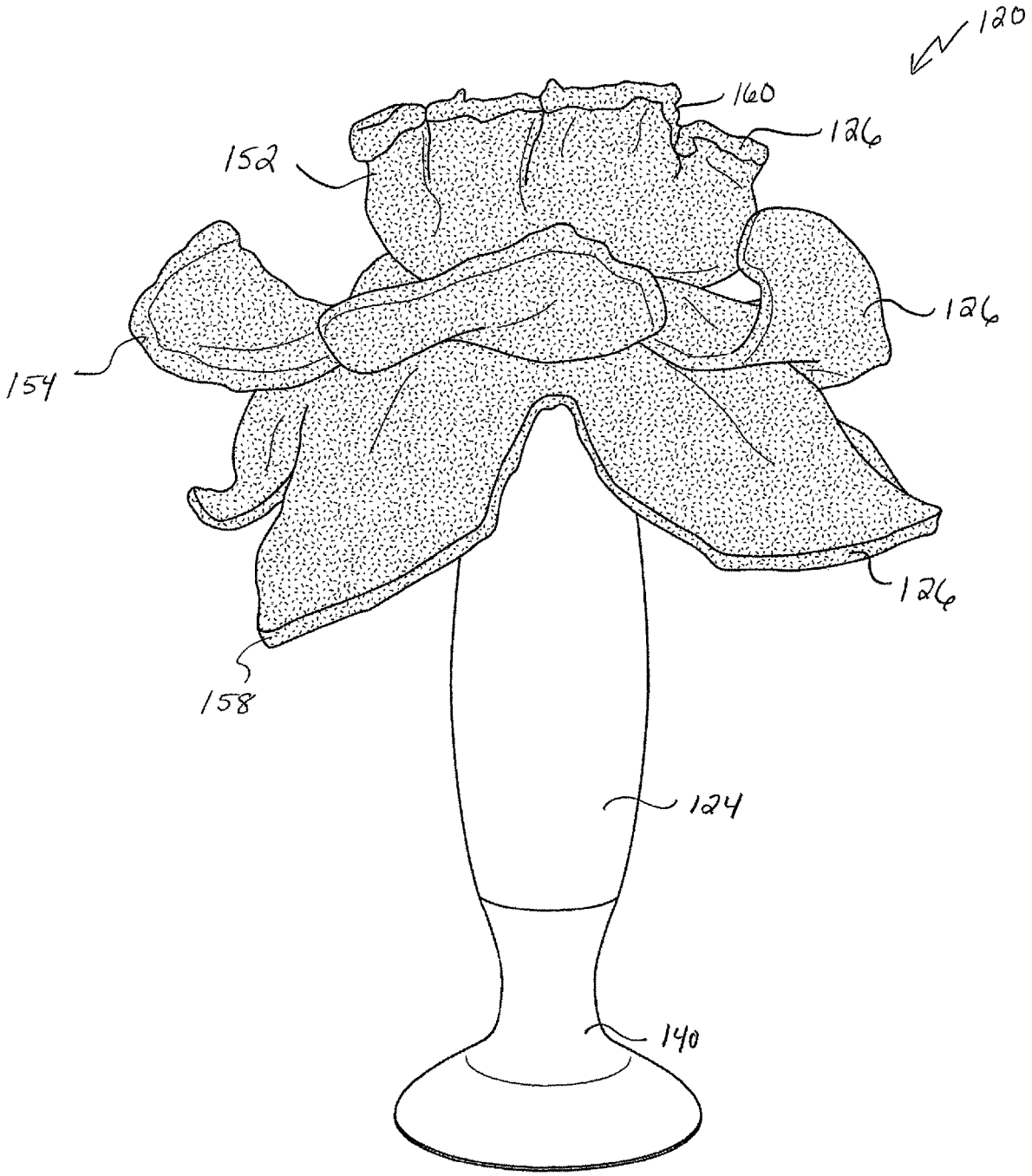
FIG. 7 is a side view of the child snacking device of FIG. 6 showing an alternative position of the first, second, and third plurality of food restraining surfaces in accordance with an embodiment of the present invention.
Figure 8:
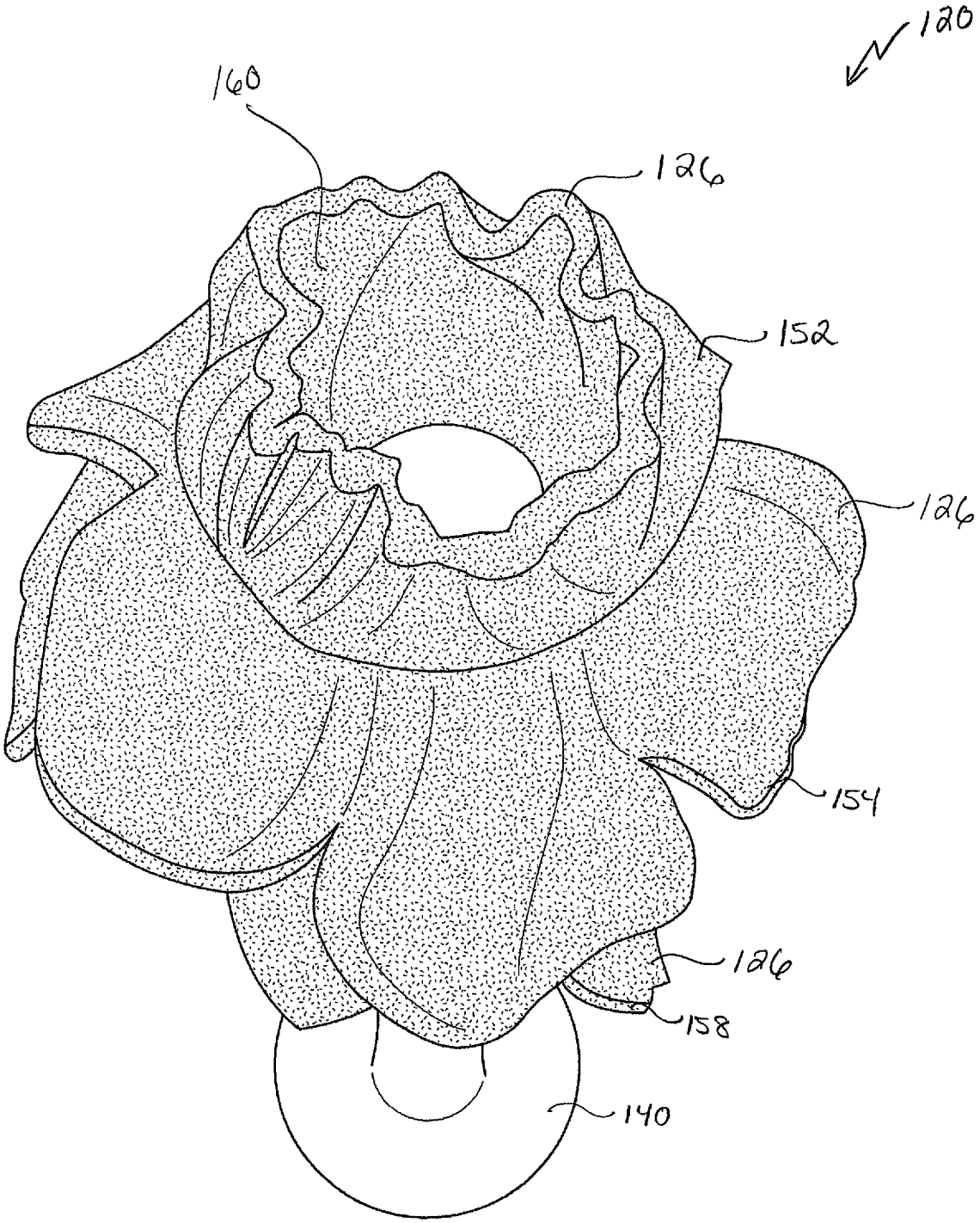
FIG. 8 is a perspective topwardly directed view of the child snacking device of FIG. 6 in accordance with an embodiment of the present invention.
Figure 9:
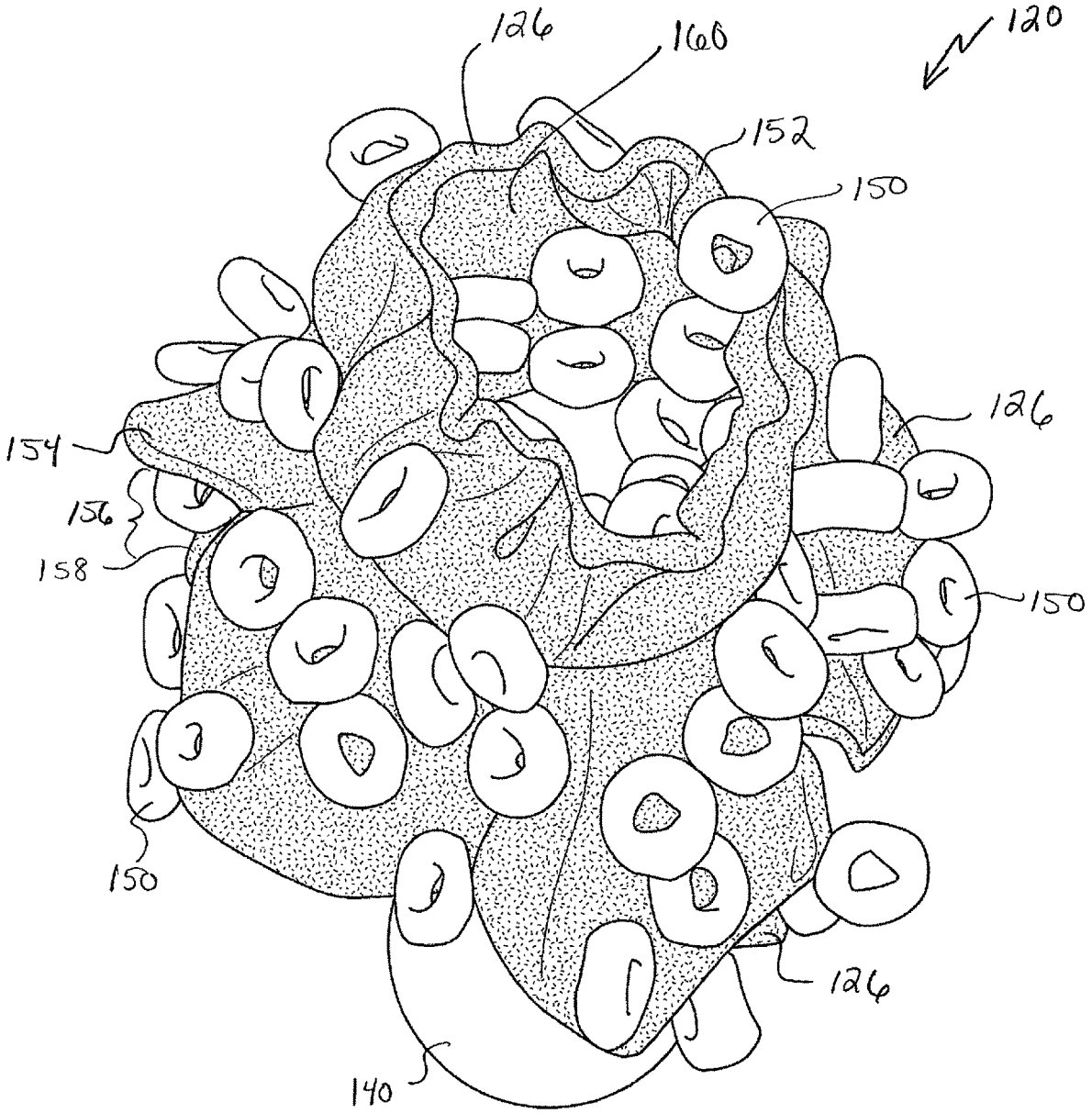
FIG. 9 is a perspective topwardly directed view of the child snacking device of FIG. 8 having a ring-shaped food product removably adhered to the food restraining surfaces in accordance with an embodiment of the present invention.
Figure 10:
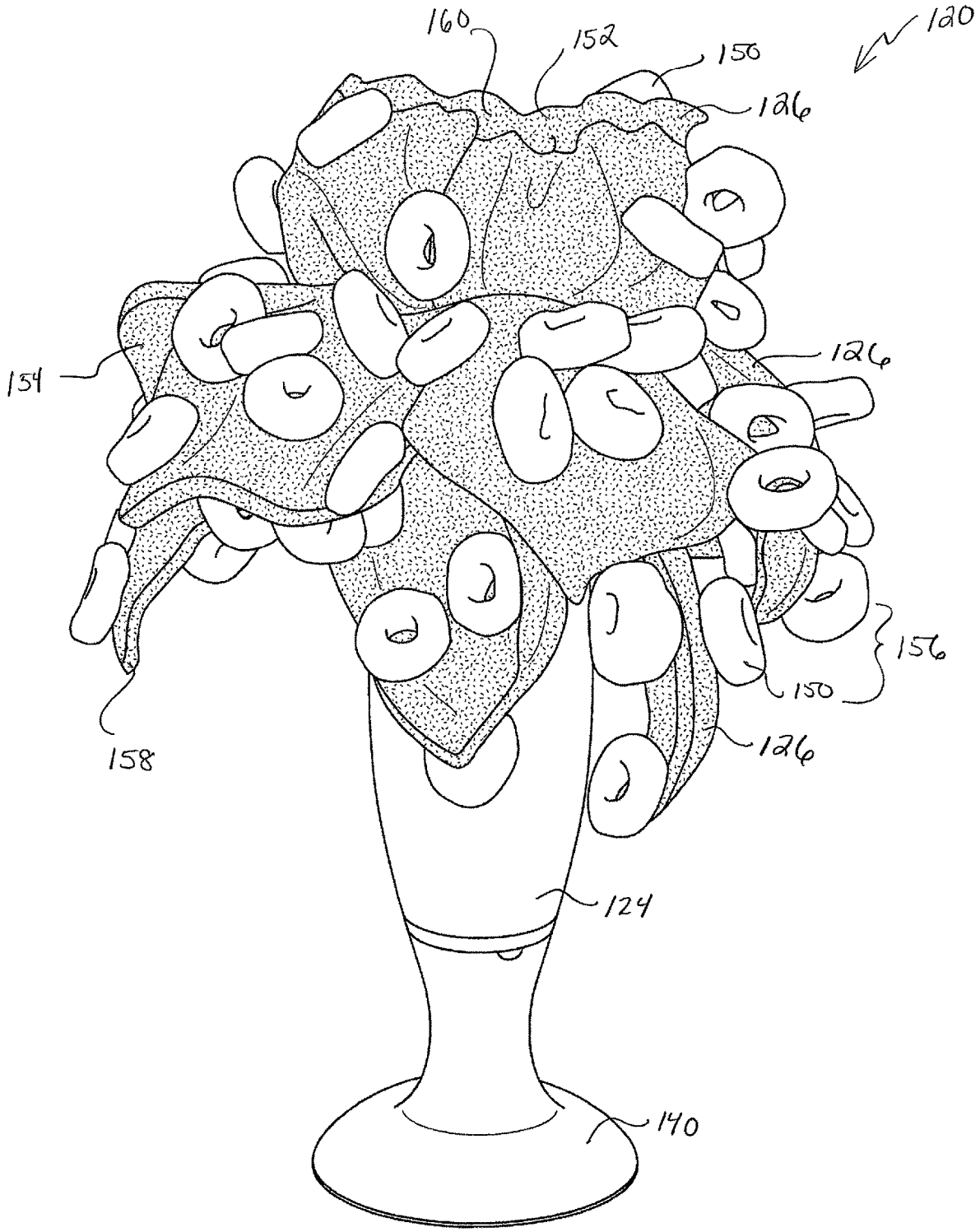
FIG. 10 is a side view of the child snacking device of FIG. 9 having the ring-shaped food product removably adhered to the food restraining surfaces in accordance with an embodiment of the present invention.
Figure 11:
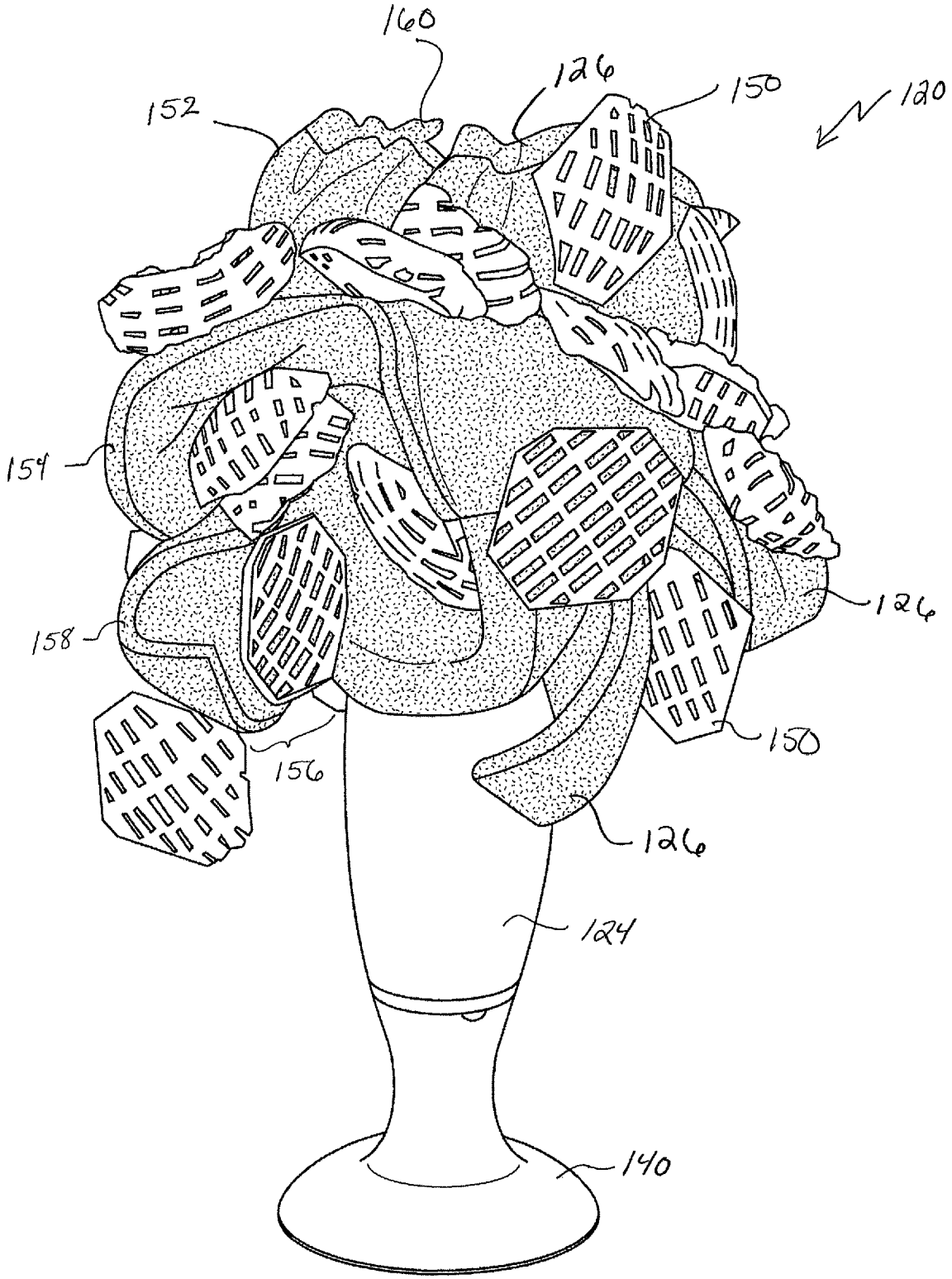
FIG. 11 is a side view of the child snacking device of FIG. 9 having a puffed geometric-shaped food product removably adhered to the food restraining surfaces in accordance with an embodiment of the present invention.

Referring once again to FIGS. 1-2, the child snacking apparatus 20 is shown prior to contact with a food product. FIGS. 3-5 illustrate the child snacking apparatus 20 after contact with a food product 50, such that the food product 50 is removably restrained to portions of the food restraining surfaces 26. During use, an adult user may invert the child snacking apparatus 20 into a container of food product 50, after which, the food product 50 becomes removably adhered to the plurality of food restraining surfaces 26. It is intended that the food restraining surfaces 26 hold the food product thereon in a persistent manner such that the food product typically remains held to the food restraining surfaces 26 until the child user intentionally removes the food product therefrom, such as with their fingers.

The food product can be any dry solid or semi-solid food. In one embodiment, the food product is a dry cereal-based food product. Non-limiting examples of dry cereal-based food products suitable for use with the present apparatus include Cheerios®, Crispix®, Wheaties®, flaked cereals, puffs, and other dry cereals with small food flake units having relatively low densities, such that the cereal dissolves quickly in the child's mouth. Dry cereal-based food products may have many different shapes, including ring-shaped cereals such as Cheerios®, flake-shaped cereals, such as Wheaties®, and/or puffed geometric shaped cereals, such as Crispix®. Other food products may include a variety of snack foods, such as crackers, cookies, goldfish crackers, raisins or other similar foods.

With reference again to FIGS. 1-5, the plurality of food restraining surfaces 26 may comprise a first layer 52 of food restraining surfaces 26 and a second layer 54 of food restraining surfaces 26. In one embodiment, at least a portion of the second layer 54 overlaps at least a portion of the first layer 52 of food restraining surfaces 26. In this configuration, the overlapping of the first and second layers 52, 54 provides additional capture pockets 56 for securing food products therein, as shown specifically with reference to FIGS. 3-4. Additional crevices, hooks, nubs, folds, cups, and/or protuberances may be provided between the first layer 52 and second layer 54, and/or provided on the surfaces of the food restraining surfaces 26 themselves, to further secure additional food product 50 thereto and/or therebetween. In the embodiment shown in FIGS. 1-5, the visual appearance of the first layer 52 may be different than the visual appearance of the second layer 54, such as by the inclusion of different colors or patterns, to allow for additional play value.

With specific reference to FIGS. 6-12, it is further contemplated herein that in another embodiment of the present invention, a child snacking device 120, including a handle 124, attachment foot 140, and a plurality of food restraining surfaces 126, as similarly described herein may be provided. In this configuration, the plurality of food restraining surfaces 126 may comprise a first layer 152 of food restraining surfaces 126, a second layer 154 of food restraining surfaces 126, and a third layer 158 of food restraining surfaces 126. In one embodiment, at least a portion of the third layer 158 overlaps at least a portion of at least one of the second layer 154 and/or the first layer 152 of food restraining surfaces 26. Optionally, portions of each of the first layer 152, the second layer 154, and the third layer 158 are overlapping. As discussed above, the overlapping regions of the first, second, and/or third layers 152, 154, 158 create additional capture pockets 156, shown specifically in FIGS. 9-11. Additional crevices, hooks, nubs, folds, cups, and/or protuberances may be provided on any of the first, second, and third layers 152, 154, and 158 to provide enhanced "hide and peek" play value. It is noted herein that any of the edges of the plurality of food restraining surfaces 26, 126 may include a soft finished edge or a polymeric supporting frame for providing enhanced rigidity.

With reference to FIGS. 6-12, at least one food restraining surface 126 may include at least one concave region 160, such as a pocket, depression, or folded region for restraining additional food product 150 therein. It is noted that while the embodiment shown in FIGS. 1-5 resembles that of a posy or daisy, the addition of the third layer 158 of food restraining surfaces 126 may impart the appearance of a daffodil to the child snacking apparatus 120. Additionally, any of the first, second, or third layers 152, 154, 158 of food restraining surfaces 126 may be provided as having a petal appearance and/or a leaf appearance. As described with reference above to FIGS. 1-2, FIGS. 6-8 show the child snacking apparatus 120 prior to contact with a food product 150, and FIGS. 9-12 show the child snacking apparatus 120 after contact with various food products 150.

Figure 13:
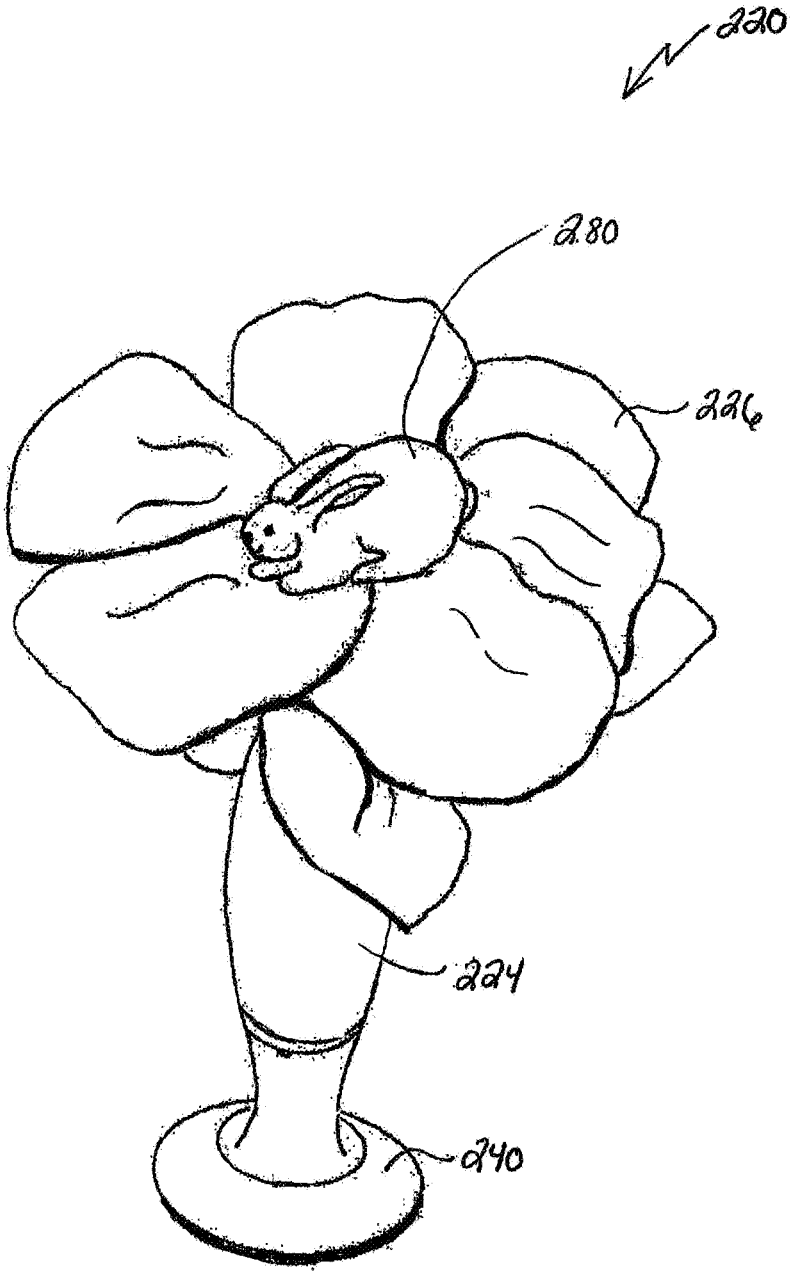
FIG. 13 is perspective side view of a child snacking device having a figural element in accordance with an embodiment of the present invention.
Figure 14:
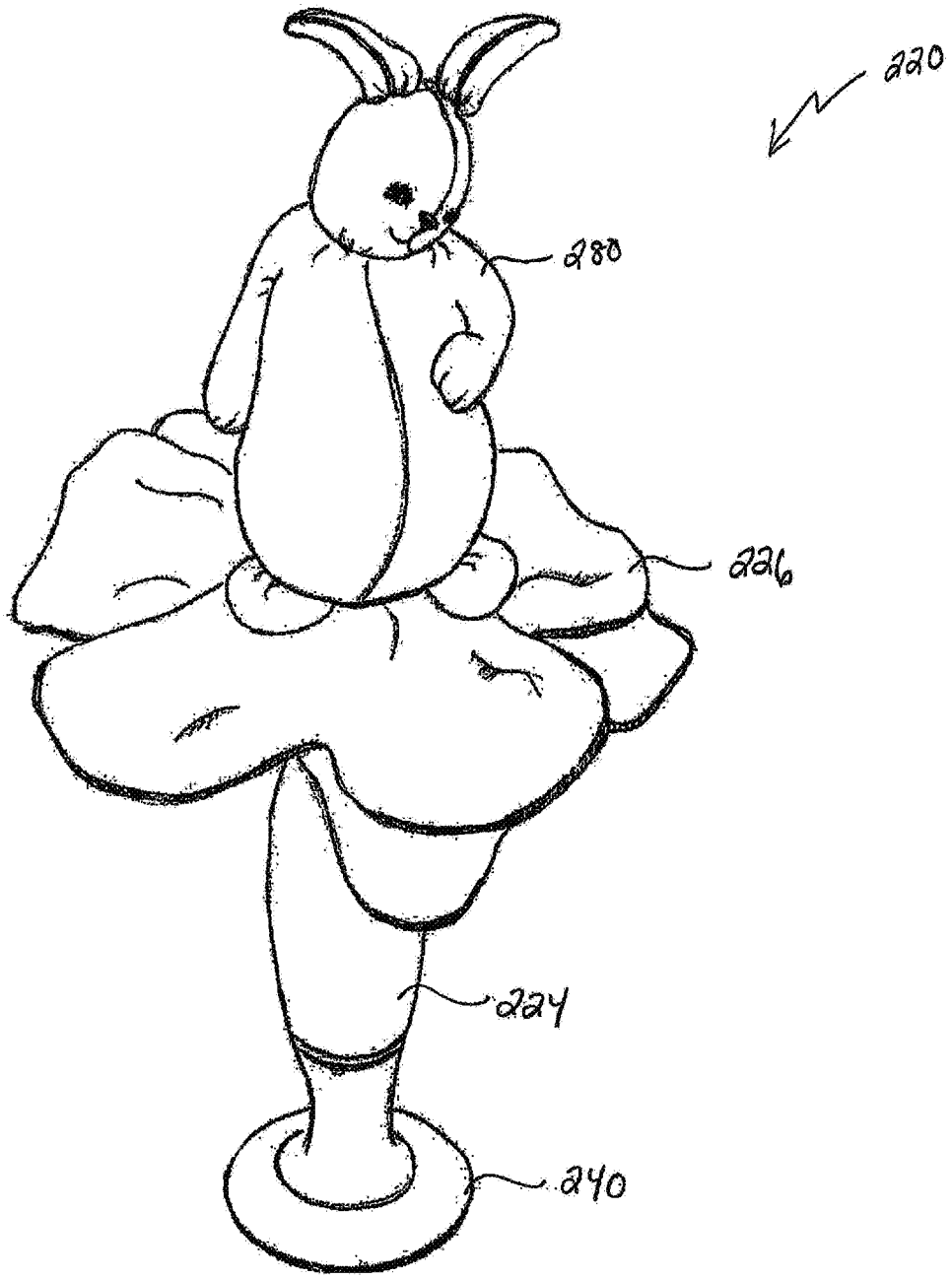
FIG. 14 is a perspective side view of a child snacking device having a figural element in accordance with an embodiment of the present invention.

With reference to FIG. 13, it is further contemplated herein that in another embodiment of the present invention, a child snacking apparatus 220, including a handle 224, attachment foot 240, and a plurality of food restraining surfaces 226, as similarly described herein may be provided. In this configuration, a figural element 280 may be provided on a portion of the child snacking apparatus 220. In one embodiment, the figural element 280 may be formed of a rigid polymeric material and may have the shape of an animal, such as a rabbit, bear, bee, etc., or may be provided in the form of an insignia or logo. The figural element 280 may be provided on the retaining cap (shown in FIG. 1), such as co-formed therewith, and may assist in the capture of the plurality of food restraining surfaces 226. In another configuration, as shown in FIG. 14, the figural element 280 may be formed of a soft fabric material. In one embodiment, the figural element 280 may be made of the same material as the plurality of food restraining surfaces 226. In another embodiment, the figural element 280 may be made of a different material than the plurality of food restraining surfaces 226. The figural element may be provided on the retaining cap (with continued reference to FIG. 1), or may be connected to at least a portion of the food restraining surfaces 226.

Figure 12:
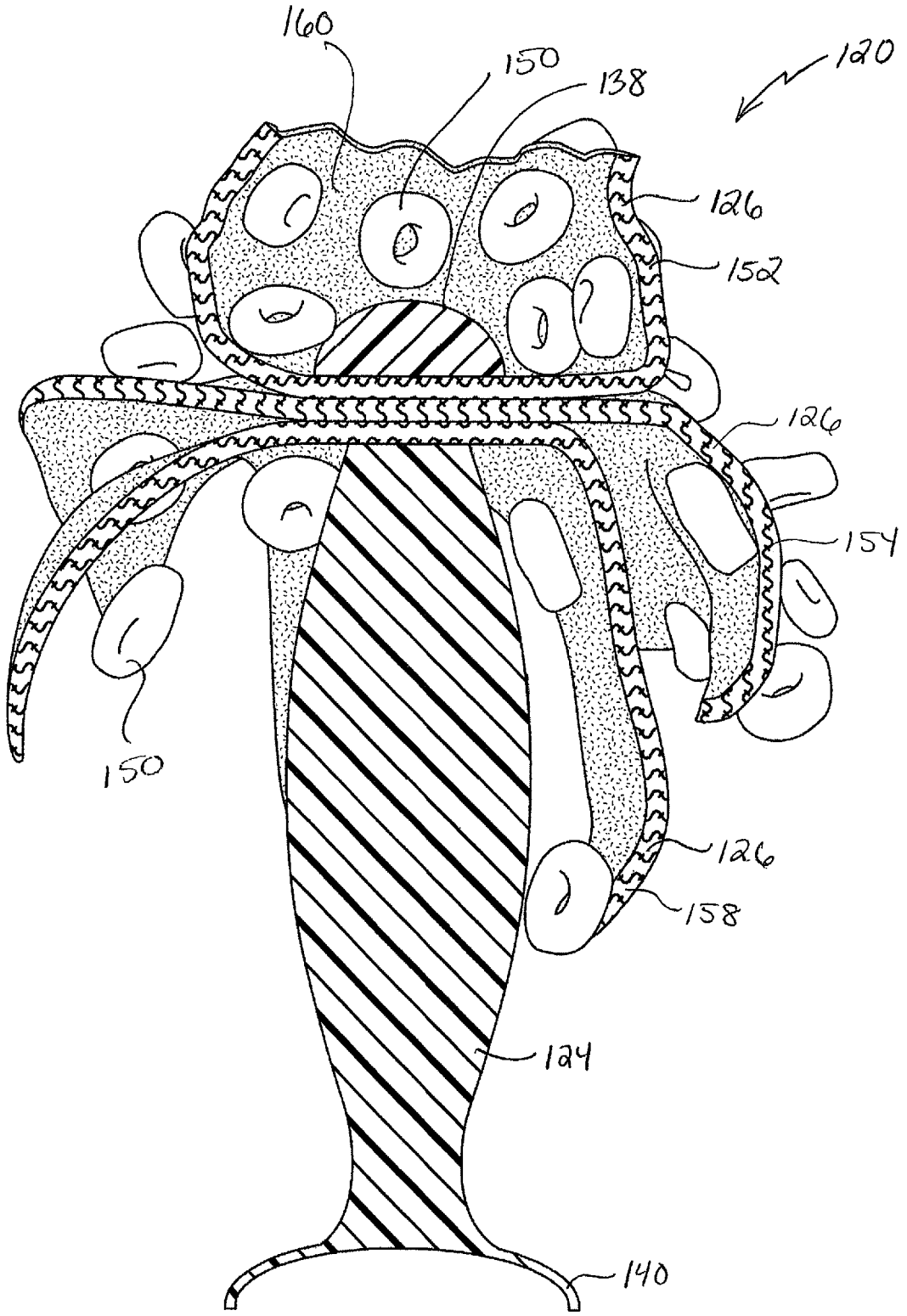
FIG. 12 is a cross-sectional side view of a child snacking device in accordance with an embodiment of the present invention.

With reference to FIGS. 1-14, the child snacking apparatus 20, 120, 220 can be provided as an integrated single piece device which is easily hand washed or dishwasher safe. All components can be made of suitable food grade materials and non-toxic. With reference to FIG. 12, the child snacking apparatus 120 may be provided such that the handle 124 and the retaining cap 138 are provided with a one-way fastener, as describer therein, such that the food restraining surfaces 126 are permanently captured between the handle 124 and the retaining cap 138. In an alternative configuration, the retaining cap 138 may be removable to allow separate washing of the food restraining surfaces 126 and subsequent reinstallment or replacement. In this configuration, the retaining cap 138 may be removed only by means of application of an intentional tool or other suitable child safety locking activation.

With reference to FIGS. 1-14, it is further contemplated herein that the food restraining surfaces 26, 126, 226 of the child snacking apparatus 20, 120, 220 may be wetted and frozen so that it may be chewed on by a child user as a teether. In another configuration, at least a portion of the handle 24, 124, 224 and/or the food restraining surfaces 26, 126, 226, and or figural element 280 may be provided with a freezable liquid to function as a teether. Optionally, the child snacking device of the present invention can be provided in a kit with at least one of a snacking container 300 for holding a food product 50, 150, 350, a washing holder 400 for securing the child snacking apparatus 20, 120, 220, 420 within a dishwasher during cleaning, and an attachment which secures the device to a child user's clothing, such as a conventional C-clip, carabiner, or other squeeze-open clasp.

Figure 15:
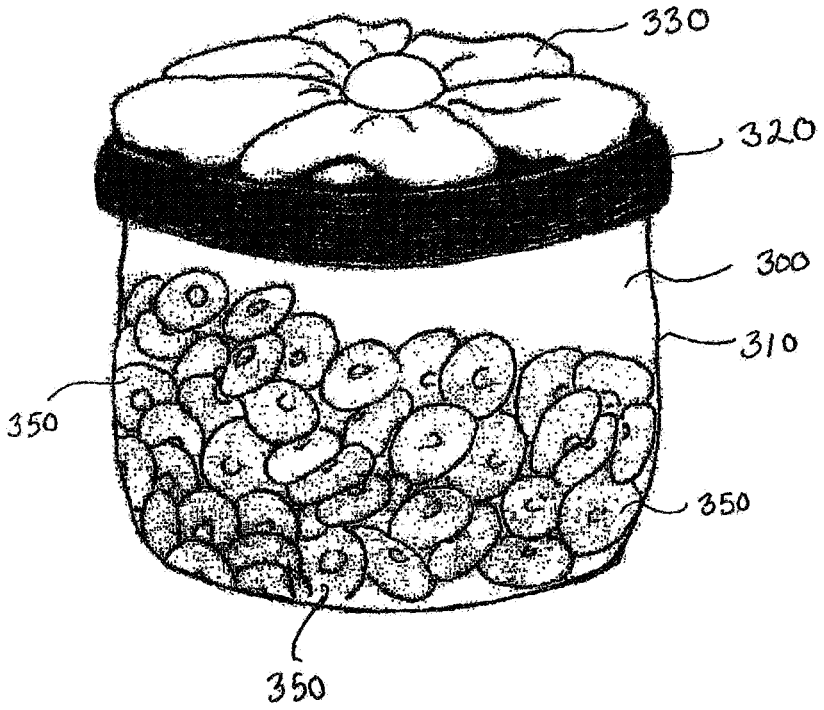
FIG. 15 is a perspective front view of a snacking container in accordance with an embodiment of the present invention.

With specific reference to FIG. 15, the snacking container 300 may have a body portion 310 and a lid 320 engageable with the body portion 310 to secure in an air-tight fashion the food product 350 for use with the child snacking apparatus as discussed herein. The lid 320 may be provided in a press-fit or screw fashion to removably engage the body portion 310. In certain embodiments, the lid 320 may include ornamental indicia and/or a figural element 330 thereon.

Figure 16:
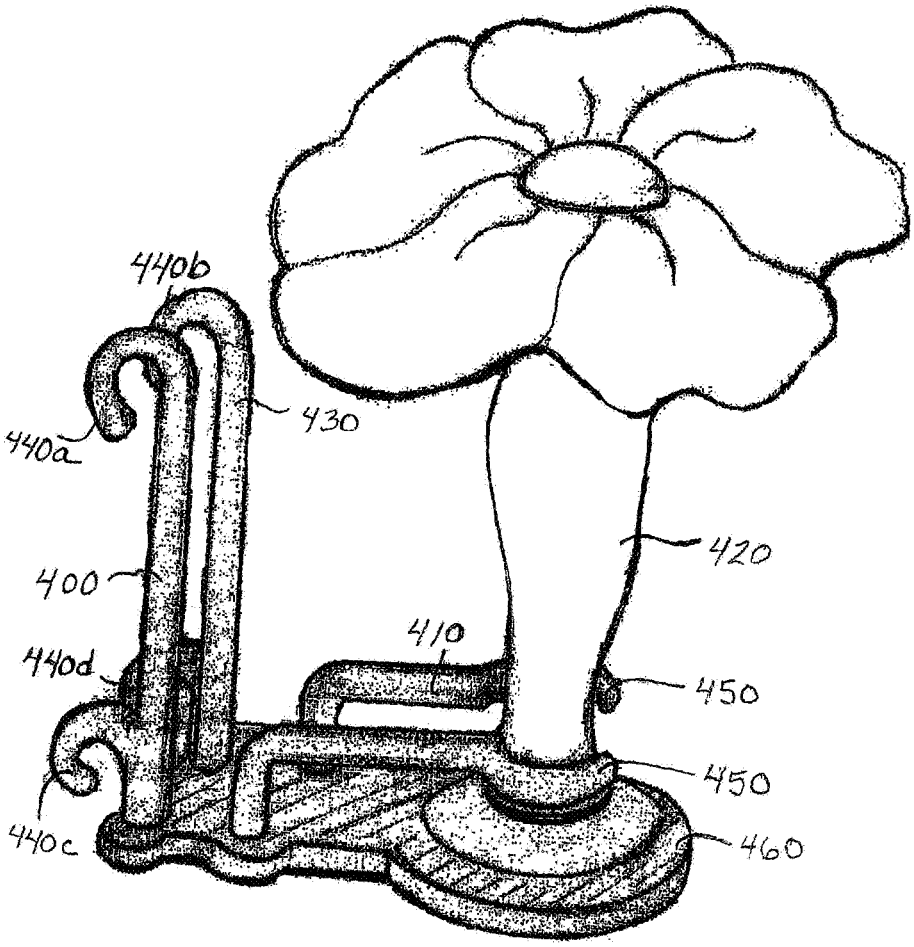
FIG. 16 is a perspective front view of a child snacking device washing holder having a child snacking device held therein in accordance with an embodiment of the present invention.

With specific reference to FIG. 16, it may be desirable to wash the child snacking apparatus 420. Although the child snacking apparatus 420 may be hand-washed, it may be desirable to wash the child snacking apparatus 420 in the dishwasher by securing the child snacking apparatus 420 in a washing holder 400. A washing holder 400 may have a child snacking apparatus engaging portion 410 for removably securing the child snacking apparatus 420 therein, and a restraining portion 430 for removable engagement with a portion of a dishwasher, such as a rack of a dishwasher. The restraining portion 430 may include at least one grasping clip 440 for engaging a wire element of a dishwasher rack. In another embodiment, the restraining portion 430 may include a pair of grasping clips 440*a*, 440*b*. In yet another embodiment, the restraining portion 430 may include a first pair of grasping clips 440*a*, 440*b* and a second pair of grasping clips 440*c*, 440*d* which are radially offset from the first pair of grasping clips 440*a*, 440*b* so as to provide multiple points of securement to the dishwasher rack. The child snacking apparatus engaging portion 410 may include a pair of restraining arms 450 which are flexibly biased to secure a portion of the child snacking apparatus 420 therein. Optionally, the child snacking apparatus engaging portion 410 may also include a base portion 460 for securing the attachment foot 460 thereto during washing.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An assembled child snacking device, comprising:

a handle, having a first end and a second end with an elongated region extending therebetween; and a plurality of petal-shaped food restraining surfaces, each petal-shaped food restraining surface having a solid planar exterior face, each petal-shaped food restraining surface comprising flexible polymeric microfiber fabric having fibers, the plurality of food restraining surfaces extending from a portion of the handle and secured thereto by a retaining cap, each of the petal-shaped food restraining surfaces extending circumferentially about the handle and radially outward from the retraining cap, wherein the fibers of the microfiber fabric removably adhere a cereal-based food product thereto; and wherein at least two of the plurality of food restraining surfaces at least partially overlap one another in the assembled device, to form a pocket to restrain the cereal-based food product therebetween.

2. The child snacking device of claim 1, wherein the polymeric microfiber fabric is made of polyester, polyamide, polypropylene, or combinations thereof.

3. The child snacking device of claim 1, wherein the polymeric microfiber fabric comprises towel terry, French terry, or looped regions.

4. The child snacking device of claim 1, wherein the first end of the handle includes an attachment foot for securing the handle to a solid surface.

5. The child snacking device of claim 1, wherein the elongated region of the handle includes at least one ergonomical gripping rib.

6. The child snacking device of claim 1, wherein the plurality of food restraining surfaces are disposed adjacent the second end of the handle and the retaining cap is permanently affixed to the second end of the handle, and at least a portion of the plurality of food restraining surfaces is captured by the retaining cap.

7. The child snacking device of claim 1, wherein the plurality of food restraining surfaces comprises a first layer of food restraining surfaces and a second layer of food restraining surfaces, wherein at least a portion of the second layer of food restraining surfaces overlaps at least a portion of the first layer of food restraining surfaces.

8. The child snacking device of claim 7, further comprising a third layer of food restraining surfaces, wherein at least a portion of the third layer of food restraining surfaces overlaps at least a portion of at least one of the first layer of food restraining surfaces and the second layer of food restraining surfaces.

9. The child snacking device of claim 1, wherein the plurality of food restraining surfaces comprises at least one concave region.

10. The child snacking device of claim 9, wherein the concave region is at least one of a pocket, depression, or folded region for restraining a food product therein.

11. The child snacking device of claim 1, wherein the plurality of food restraining surfaces are petal-shaped.

12. The child snacking device of claim 9, wherein the elongated region of the handle is stem-shaped.

13. The child snacking device of claim 1, wherein the retaining cap includes at least one of indicia and a figural addition thereon.

14. The child snacking device of claim 1, wherein the plurality of food restraining surfaces removably adhere a cereal-based food product thereto.

15. An assembled child snacking device, comprising:

a core region; and a plurality of petal-shaped food restraining surfaces, each petal-shaped food restraining surface having a solid planar exterior face, each petal-shaped food restraining surface comprising flexible polymeric microfiber fabric, each of the petal-shaped food restraining surfaces extending circumferentially about the core and extending radially outward therefrom, each of the petal-shaped food restraining surfaces having fibers extending from the core region, wherein the fibers of the microfiber fabric removably adhere a cereal-based food product thereto, wherein at least two of the plurality of food restraining surfaces at least partially overlap one another, in the assembled device, to form a pocket to restrain the cereal-based food product therebetween.

16. The child snacking device of claim 15, wherein the polymeric microfiber fabric is made of polyester, polyamide, polypropylene, or combinations thereof.

17. The child snacking device of claim 15, wherein the polymeric microfiber fabric comprises towel terry, French terry, or looped regions.

18. The child snacking device of claim 15, wherein the plurality of food restraining surfaces comprises a first layer of food restraining surfaces and a second layer of food restraining surfaces, wherein at least a portion of the second layer of food restraining surfaces overlaps at least a portion of the first layer of food restraining surfaces.

19. The child snacking device of claim 18, further comprising a third layer of food restraining surfaces, wherein at least a portion of the third layer of food restraining surfaces overlaps at least a portion of at least one of the first layer of food restraining surfaces and the second layer of food restraining surfaces.

20. The child snacking device of claim 15, wherein the plurality of food restraining surfaces comprises at least one concave region.

21. The child snacking device of claim 20, wherein the concave region is at least one of a pocket, depression, or folded region for restraining a food product therein.

22. The child snacking device of claim 15, wherein the plurality of food restraining surfaces are petal-shaped.

* * * * *